US007296375B2

(12) United States Patent
Brunn

(10) Patent No.: US 7,296,375 B2
(45) Date of Patent: Nov. 20, 2007

(54) SHOTGUN LAUNCHING CUP

(76) Inventor: Michael Brunn, 308 Littleworth La., Sea Cliff, NY (US) 11579

( * ) Notice: Subject to any disclaimer, the term of this patent is extended or adjusted under 35 U.S.C. 154(b) by 358 days.

(21) Appl. No.: 10/843,547

(22) Filed: May 10, 2004

(65) Prior Publication Data

US 2007/0234624 A1 Oct. 11, 2007

Related U.S. Application Data

(60) Provisional application No. 60/469,305, filed on May 8, 2003.

(51) Int. Cl.
*F41C 27/06* (2006.01)

(52) U.S. Cl. ..... 42/105; 89/1.1

(58) Field of Classification Search ..... 42/86, 42/75.01, 105, 1.14–1.15, 1.13; 89/1.14, 89/1.34, 1.1, 29
See application file for complete search history.

(56) References Cited

U.S. PATENT DOCUMENTS 940,527 A * 11/1909 Hale ..... 102/483
1,260,021 A * 3/1918 Otterson ..... 42/86
2,365,586 A * 12/1944 Pearson ..... 42/105
2,388,749 A * 11/1945 La Pierre ..... 242/129.5
2,939,449 A * 6/1960 Kortick ..... 124/28
3,127,691 A * 4/1964 Moore ..... 42/105
3,257,905 A * 6/1966 Weisman et al. ..... 89/1.1
3,279,114 A * 10/1966 Lewis et al. ..... 42/105
3,318,033 A * 5/1967 Barr ..... 42/105
3,404,478 A * 10/1968 Silsby ..... 42/105
3,967,402 A * 7/1976 Cooksey ..... 42/10
4,689,911 A * 9/1987 White ..... 42/105
4,713,903 A 12/1987 Mainland
4,799,906 A * 1/1989 Perkins, Jr. ..... 441/85
5,666,756 A 9/1997 Moller
6,688,032 B1 2/2004 Gonzalez et al.

* cited by examiner

*Primary Examiner*—Michelle Clement
(74) *Attorney, Agent, or Firm*—Cohen Pontani Lieberman & Pavane LLP

(57) ABSTRACT

A launching cup has a horseshoe-shaped segment with a right and a left extension, each extension having a hole, and a pin can be inserted through the holes in the extensions to thereby prevent the launching cup from shaking or otherwise falling off the muzzle of the firearm.

20 Claims, 10 Drawing Sheets

SHOTGUN LAUNCHING CUP

RELATED APPLICATIONS

This application claims priority from U.S. Provisional Patent Application Ser. No. 60/469,305 which was filed on May 8, 2003, and which is hereby incorporated in its entirety.

BACKGROUND OF THE INVENTION

1. Field of the Invention

The present invention relates generally to a launching cup, and particularly to a shotgun launching cup.

2. Description of the Related Art

Muzzle launched projectiles have been in use for over a century. When launching a projectile from the muzzle of a firearm, such as a rifle or shotgun, a launching cup is attached to the muzzle of the firearm, the projectile is placed in the launching cup, and a blank round is used to launch the projectile. This method of launching projectiles provides advantages in terms of range and accuracy over hand-thrown counterparts and requires only a conventional firearm instead of a specialized launcher. Projectiles which can be launched by means of a launcher cup include, but are not limited to: flash grenades, concussion grenades, nets, noise generators, stun balls, tire puncturing elements, electromagnetic pulse generators, mines or bomblets, listening devices, signal emitting devices, and unmanned aerial vehicles.

FIGS. 1 and 2 show a conventional launching cup, both attached to a rifle and alone. These drawings are taken from the U.S. Navy's Nonresident Training Course (NRTC) Manual for Gunner's Mate 1 & C (Naval Education and Training Professional Development and Technology Center, NAVEDTRA 14110; published 1996), which is hereby incorporated by reference. As shown in FIGS. 1 and 2, a conventional launching cup consists of a cylindrical steel tube approximately 8.5 inches long and 2.75 inches in diameter at the connecting end, or adapter portion, which fits over the muzzle of the firearm. The launcher is shown in FIG. 1 attached to a M14 rifle, with a projectile in front of the bell or cup portion of the launcher in which the projectile is inserted.

The launching cup in FIGS. 1 and 2 uses a wire loop, a latch, and a safety retaining pin to attach itself to the firearm, which, in this particular case, is an M14 rifle. When this particular launching cup is used, the adapter portion fits over the flash suppressor of the M14 rifle, and the wire loop fits over the rifle's bayonet lug, as shown in FIG. 1. In order to lock the launching cup onto the rifle, the safety retaining pin (attached by a lanyard to the cup so it will not be lost) fits through the latch.

Although this type of attachment system is acceptable in most cases, problems may occur in situations of real danger or combat. For example, if the launching cup is being used to fire tear gas grenades at an approaching crowd, and then the crowd charges, there may be a need to fire live rounds from the rifle without removing the launching bell. However, most launching cup attachment systems are not reliable when live rounds are being fired. The vibrations caused by the firing of live rounds can shake the launching cup off the end of the firearm's muzzle, thus putting the user at risk.

Because of this, there is a need for a launching cup attachment system which is capable of remaining firmly locked into position while the firearm is being used to fire live rounds.

SUMMARY OF THE INVENTION

One object of the present invention is to provide a launching cup attachment system which is capable of remaining firmly locked into position while the firearm is being used to fire live rounds.

This and other objects are accomplished by the present invention which provides a system and method of attaching a launching cup to a firearm in such a manner that the firing of live rounds will not cause the launching cup to shake loose. The presently preferred embodiments of the present invention use a portion of the firearm to obstruct the movement of a safety pin once the safety pin is locked in place within the launching bell. In particular, a ball-lock T-pin is engaged in a portion of the launcher cup behind the magazine tube ring support of the shotgun, which prevents the launcher cup from being shaken, or otherwise falling off, the muzzle of the shotgun.

Other objects and features of the present invention will become apparent from the following detailed description considered in conjunction with the accompanying drawings; whereas the various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
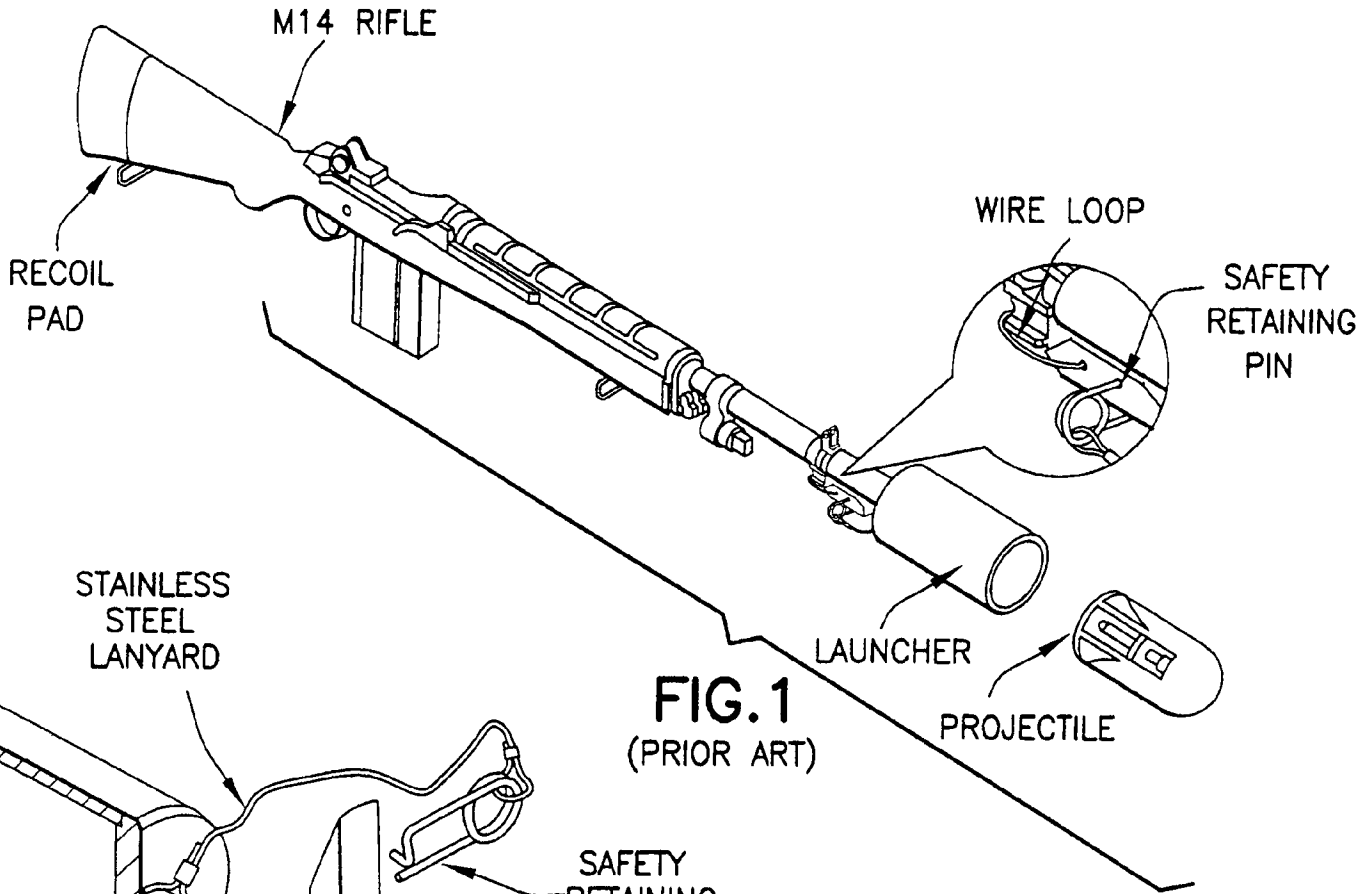
FIG. 1 (PRIOR ART)
FIG. 1 shows a rifle with an attached launcher cup according to the prior art.
Figure 2:
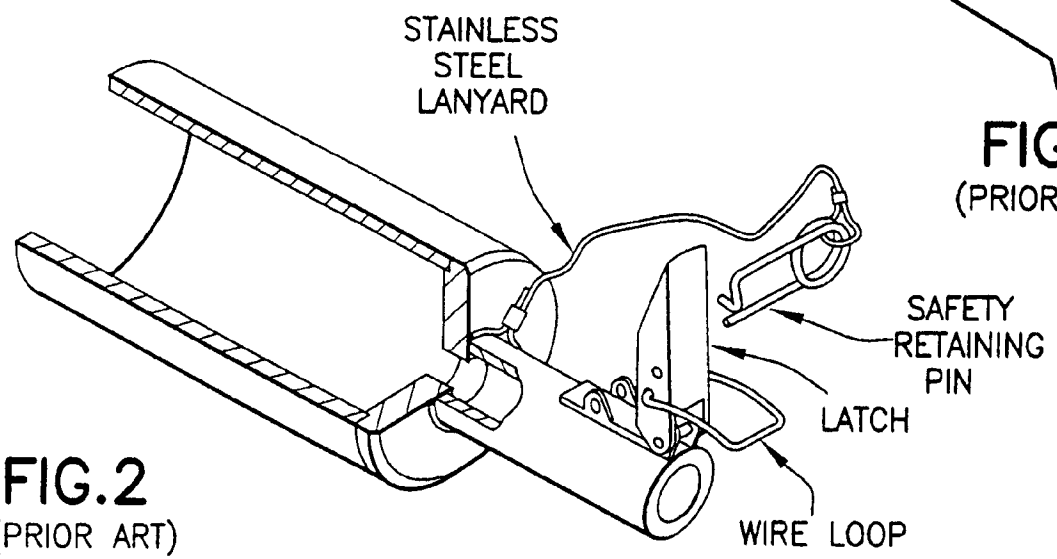
FIG. 2 (PRIOR ART)
FIG. 2 shows the launcher cup of FIG. 1 in greater detail.

The presently preferred embodiments of the present invention are in the form of a launching cup for a shotgun, in particular, a Mossberg M500 shotgun, but the invention itself may be applied to a variety of firearms, including hand-held and shoulder weapons, weapons with rifled barrels, and weapons with smooth-bore barrels. In the preferred embodiment, the launching cup has a horseshoe-shaped segment at the end of an adapter portion. The horseshoe-shaped segment has a right and a left extension, and there are symmetrical matching holes in the ends of each extension. The matching holes in the horseshoe-shaped segment are for engaging a ball-lock safety pin. Once the ball-lock safety pin is slid through the matching holes in the horseshoe-shaped segment, protrusions on the distal end of the ball-lock safety pin are extended, thus locking the ball-lock safety pin in place within the matching holes of the horseshoe-shaped segment. Once locked into place, the ball-lock safety pin will not allow the launching cup to vibrate or otherwise shake off of the end of the shotgun muzzle, because the ball-lock safety pin can not slide past the magazine tube ring support of the shotgun, as will be described in greater detail below and shown in the drawings.

Figure 3:
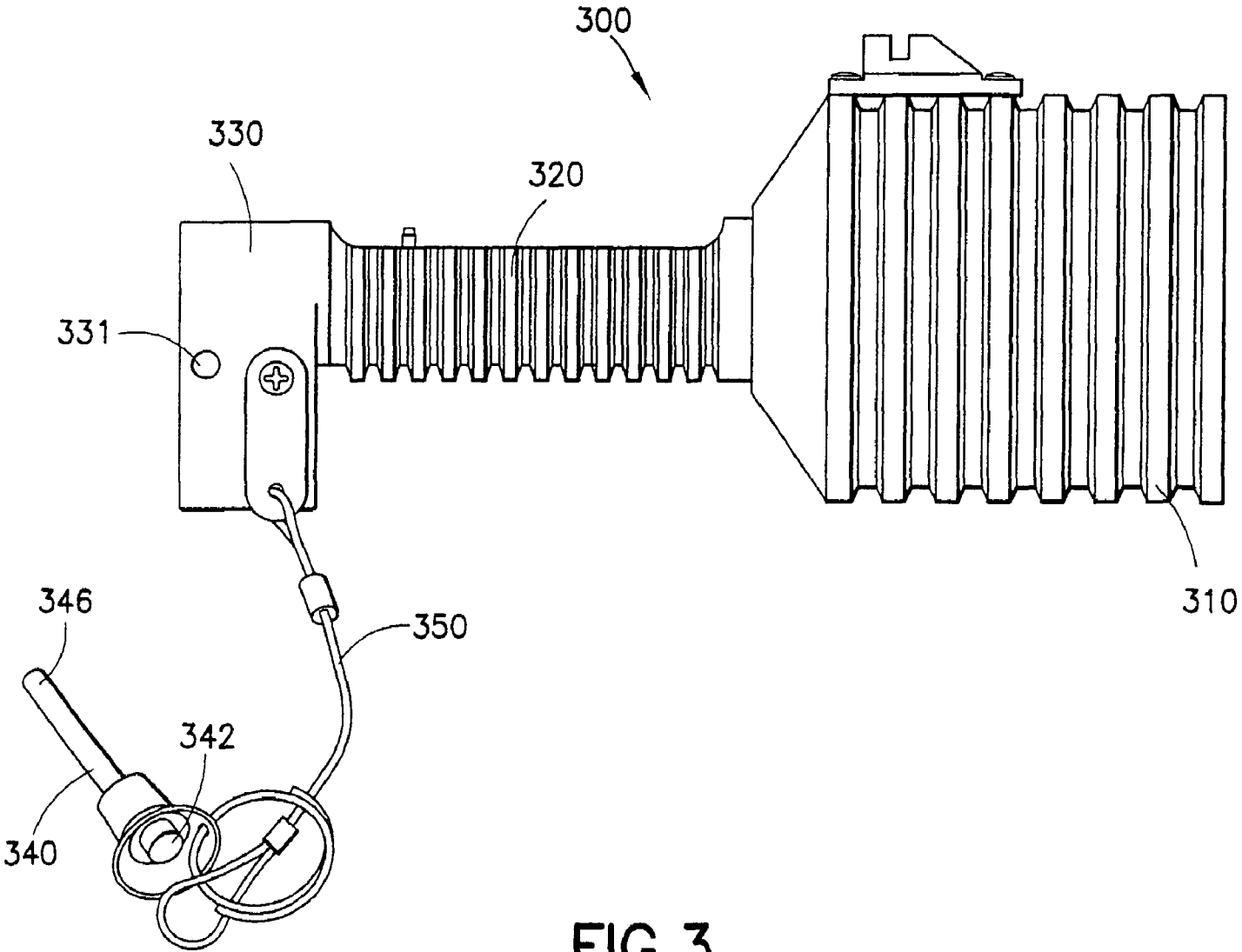
FIG. 3 shows a launcher cup according to a first preferred embodiment of the present invention.

FIG. 3 is a side view of a first preferred embodiment of the present invention. The three basic parts are shown: the bell or cup portion 310, the adapter portion 320, and the horseshoe segment 330. Only one side of horseshoe segment 330 with its single symmetrical hole 331 can be seen in FIG. 3. Ball-lock safety pin (or "T-pin") 340 is not inserted into the hole 331 of the horseshoe segment 330, but remains attached to the launching cup 300 by lanyard 350. When the button 342 on the end of the ball-lock safety pin 340 is pressed, the protrusions at the distal end 346 retract, thus allowing one to insert the distal end 346 into and through hole 331 in the horseshoe segment 330.

Figure 4A:
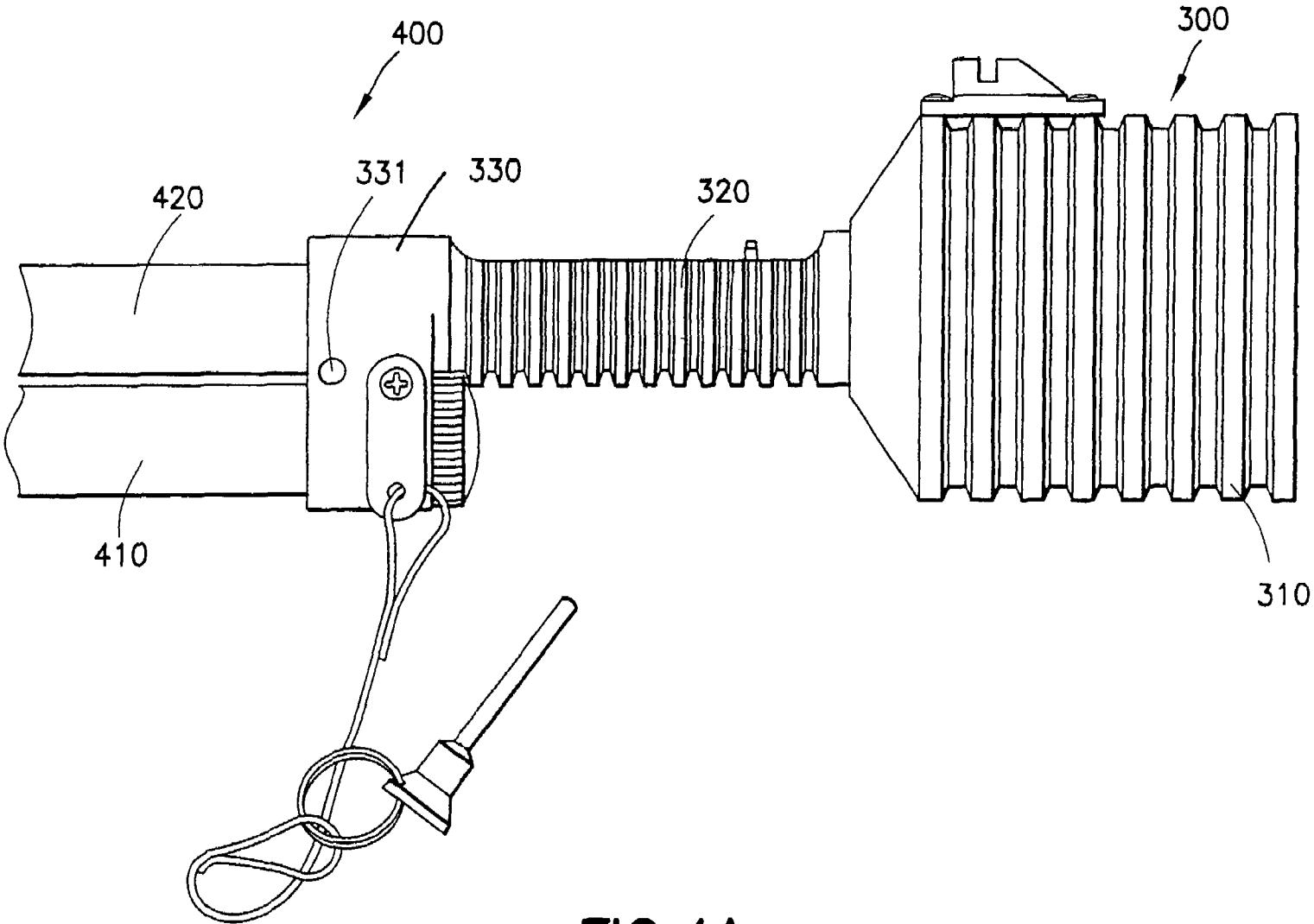
FIGS. 4A-4B show the launcher cup of FIG. 3 being attached to a shotgun according to a first preferred embodiment of the present invention.

FIG. 4A is a right-hand side view of the first preferred embodiment when it is attached to, but not locked onto, a shotgun 400. The adapter portion 320 has been slid onto the muzzle of shotgun 400 and the horseshoe segment 330 encircles the end of the magazine tube 410 of the shotgun. Although not seen in FIGS. 4A-4D, a small length of metal, the magazine tube ring support, connects the barrel 420 and the magazine tube 410 of the shotgun 400. The magazine tube ring support in FIGS. 4A-4D is hidden under the horseshoe segment 330 of the launching cup 300; it is located to the right of hole 331 in the horseshoe segment 330. The magazine tube ring support of a shotgun can be seen in FIG. 5A described below.

Figure 4B:
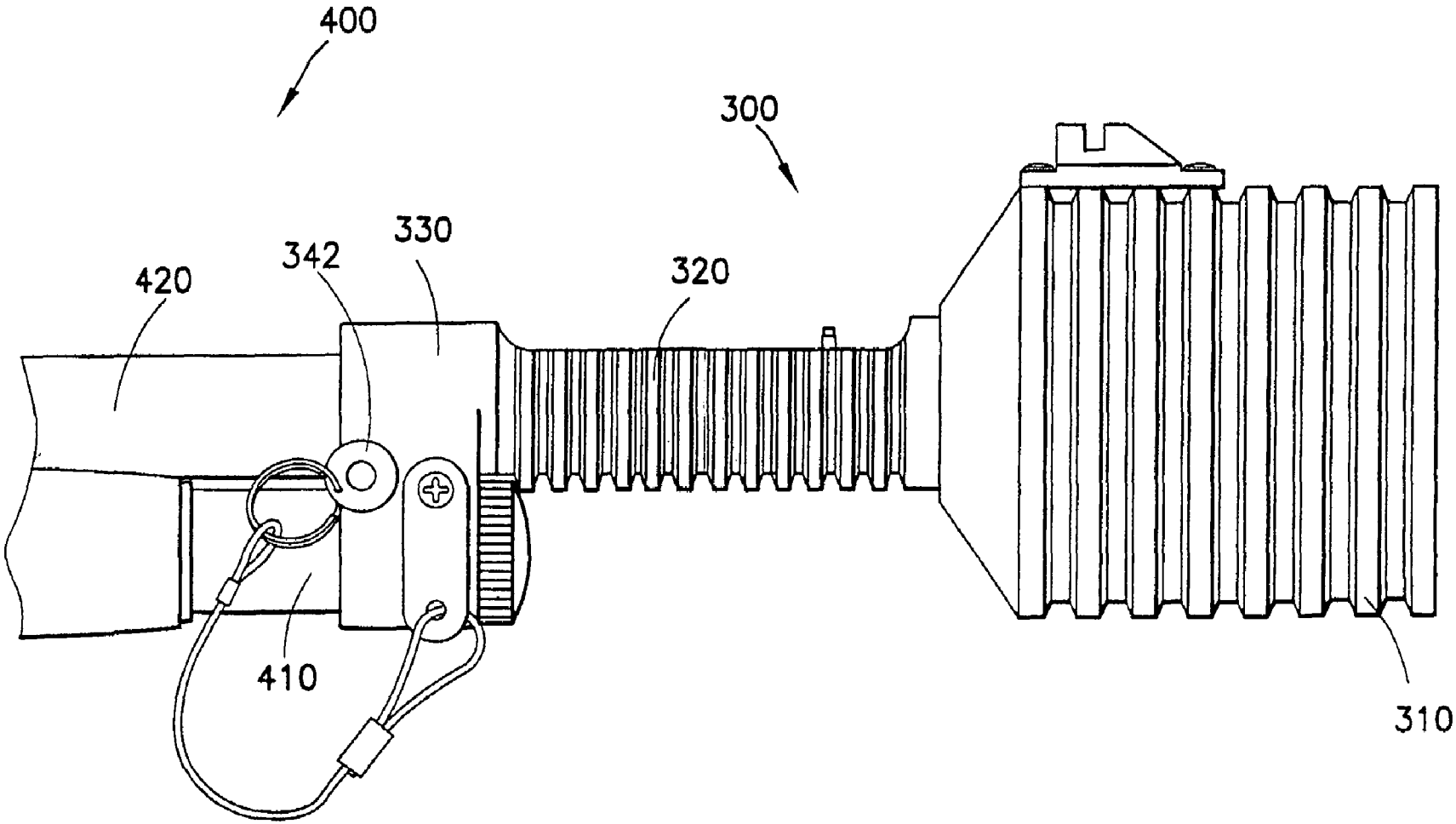

FIG. 4B is a right-hand side view of the first preferred embodiment when it is attached and locked onto the shotgun. In FIG. 4B, the ball-lock safety pin 340 has been inserted through both holes in the horseshoe segment 330 of the launching cup 300, thereby locking the launching cup 300 on the muzzle, and barrel 420 of shotgun 400. In order to insert the ball-lock safety pin 340 through the horseshoe segment 330, the button 342 on the ball-lock safety pin 340 is pressed causing the protrusions at the distal end 346 of the safety pin 340 to retract. With the protrusions retracted, it is possible for the distal end 346 of the safety pin 340 to pass through both holes in the horseshoe segment 330. Once the distal end 346 has exited out the other side of the horseshoe segment 330, the button 342 is released, and the protrusions pop back out. The protrusions, when extended, do not allow the distal end 346 of the safety pin 340 to fit through the holes in the horseshoe segment 330, thereby holding the safety pin 340 in place. The magazine support (not shown in FIGS. 4A-4D) connecting the barrel 420 and magazine tube 410 of shotgun 400 is located to the right of the engaged safety pin in FIGS. 4B-4C. Because the safety pin 346 when engaged in horseshoe section 330 cannot move past the magazine tube ring support, the launching bell 300 cannot slide, vibrate, or otherwise fall off of the muzzle of shotgun 400.

Figure 4C:
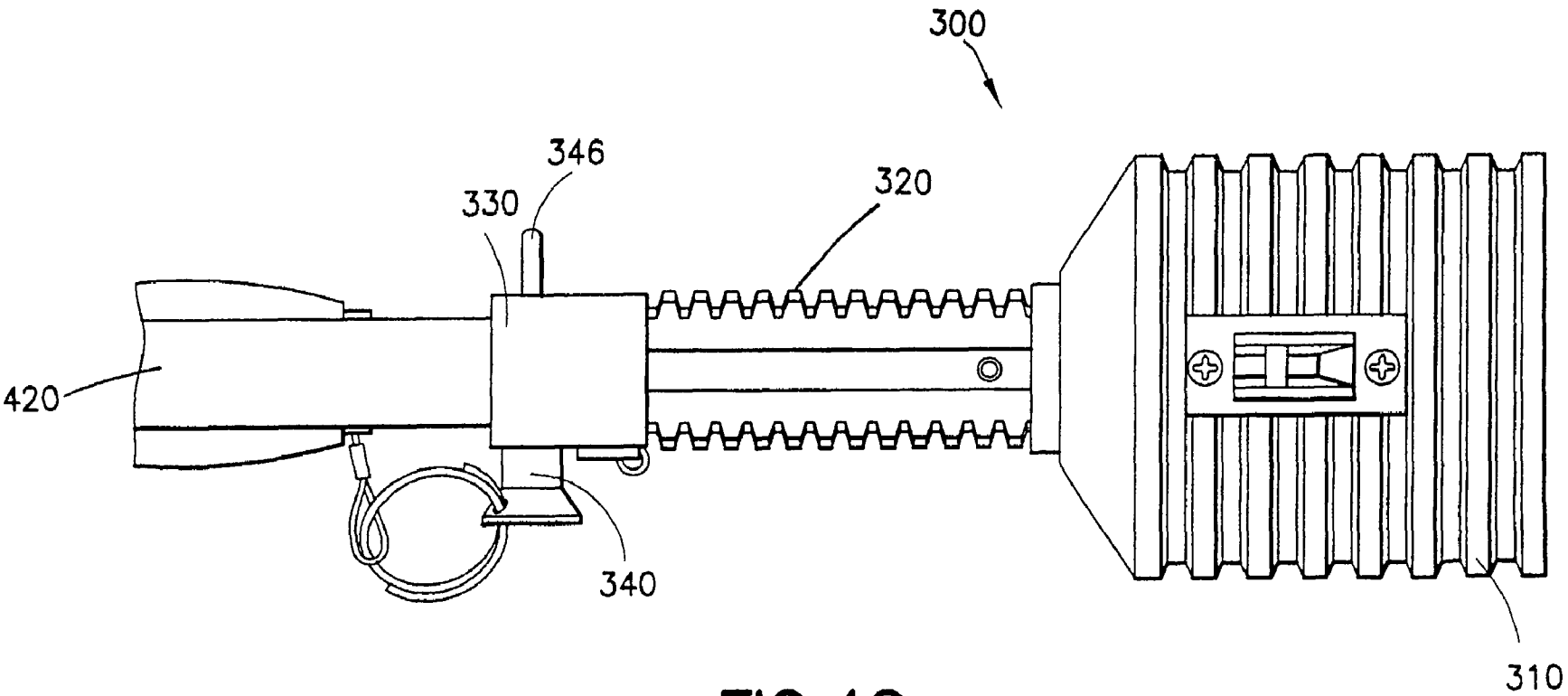
FIGS. 4C-4D show a top view and an opposite side view of the launcher cup of FIG. 3 attached to a shotgun according to a first preferred embodiment of the present invention.
Figure 5A:
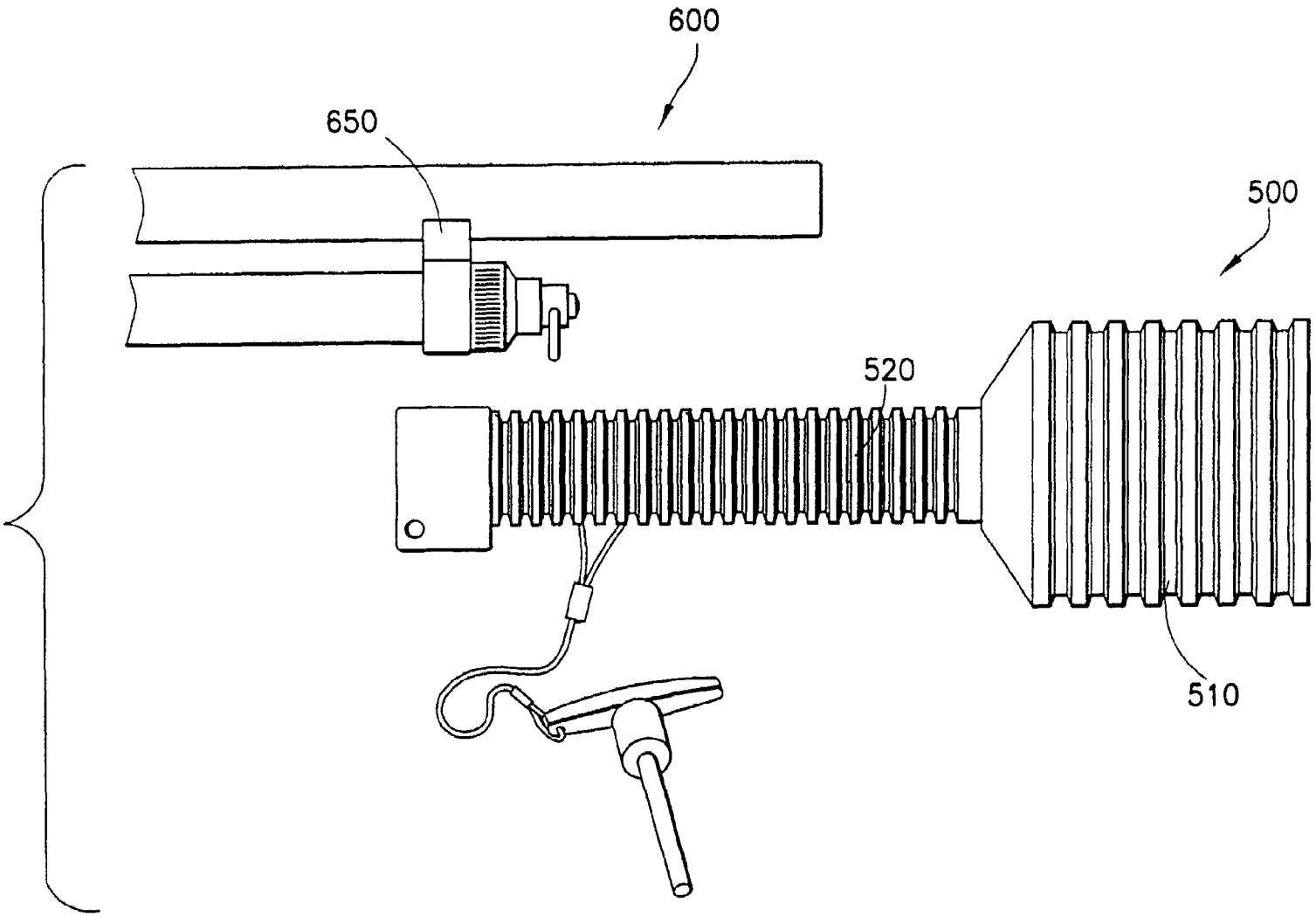
FIG. 5A shows a launcher cup according to a second preferred embodiment of the present invention.

FIG. 4C is a top view of the first preferred embodiment when attached and locked to shotgun 400. Both ends of safety pin 340 can be seen on either side of the shotgun in FIG. 4C. Furthermore, the first preferred embodiment seen in FIG. 4C has a open groove extending along the top of the adapter portion 320 of the launching cup 300. The open groove is for the sight on the end of the shotgun barrel, and ensures that the launching cup is positioned correctly on the shotgun. In the first preferred embodiment, a sight is constructed on the appropriate section of the launching cup to aid in aiming the muzzle-launched projectile.

Figure 4D:
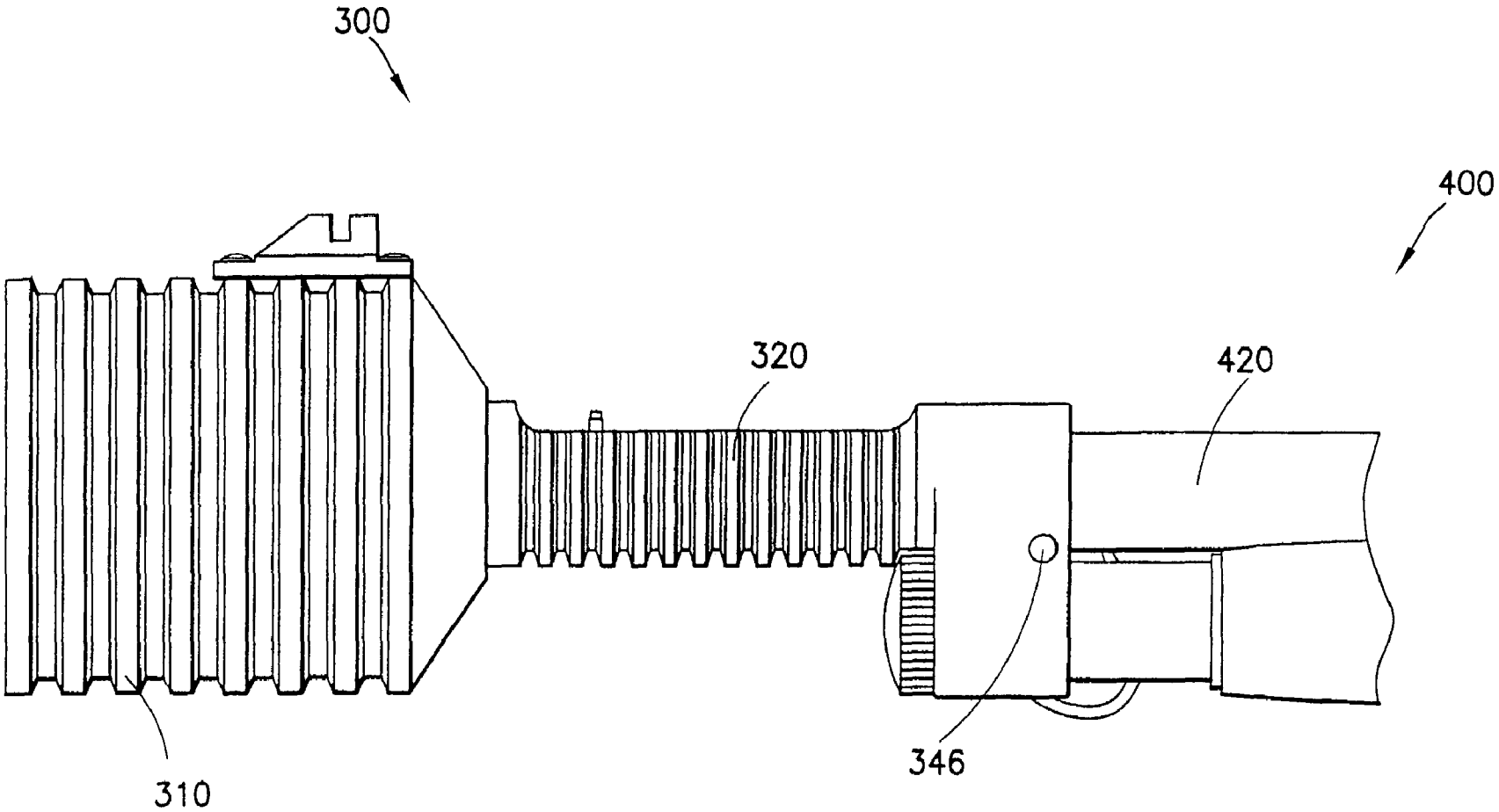

FIG. 4D is a view from the other side of the shotgun of the first preferred embodiment of the present invention (i.e., on the opposite side from the view of FIGS. 4A-4B). The distal end 346 of the ball lock 340 can be seen sticking out of the hole in the horseshoe section 330.

FIGS. 5A-5C and FIGS. 6A-6B show a launcher cup according to a second preferred embodiment of the present invention. The launcher cup 500 according to the second preferred embodiment has a longer adapter section 520 than the adapter section 320 of the launcher cup 300 according to the first preferred embodiment of the present invention. The adapter section 320 or 520 according to the first and second embodiments must change in length so that the holes in horseshoe segment 330 or 530 will be located on the other side of the magazine tube ring support when the launcher cup 300 or 500 is fully engaged on the barrel of the shotgun, thereby ensuring that ball lock pin 340 will securely lock the launcher cup 300 or 500 to the shotgun. Magazine tube ring support 650 of shotgun 600 can be seen in FIG. 5A.

Figure 5B:
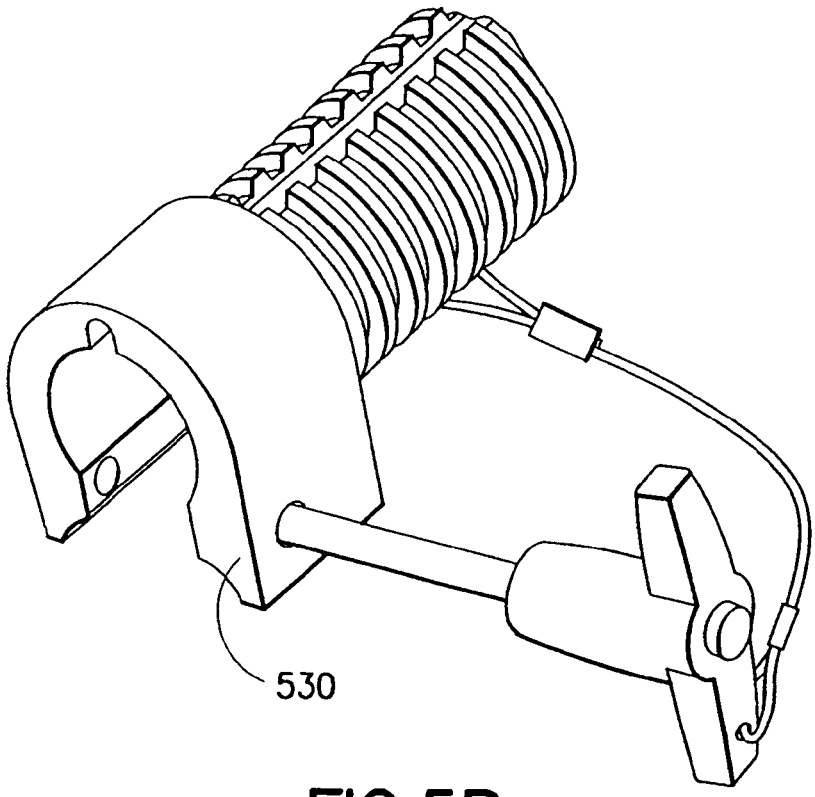
FIGS. 5B-5C shows the horseshoe section of the launcher cup of FIG. 5A according to a second preferred embodiment of the present invention.
Figure 5C:
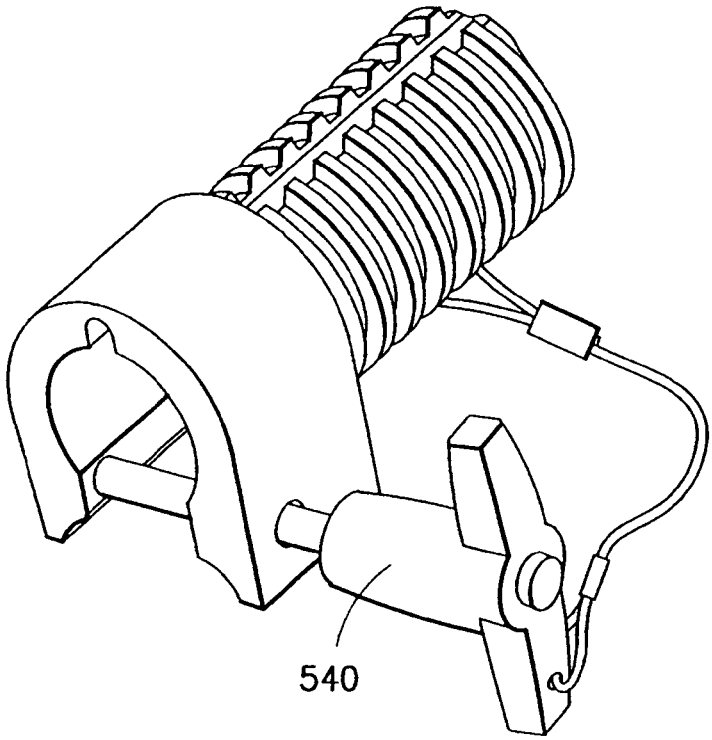

FIGS. 5B and 5C have good close-up views of the horseshoe segment 530 of the second preferred embodiment, as well as the groove that runs along the top of the adapter portion 520 of the launching cup 500 (and through horseshoe segment 530). The sight on the barrel of the shotgun rides in the groove when launcher cup 500 is being slid onto the barrel of the shotgun. FIG. 5B shows the T-pin 540 inserted into the hole on one side of horseshoe segment 530, but not pushed all the way through to the hole on the other side of horseshoe segment 530. FIG. 5C shows T-pin 540 fully inserted through horseshoe section 530.

Figure 6A:
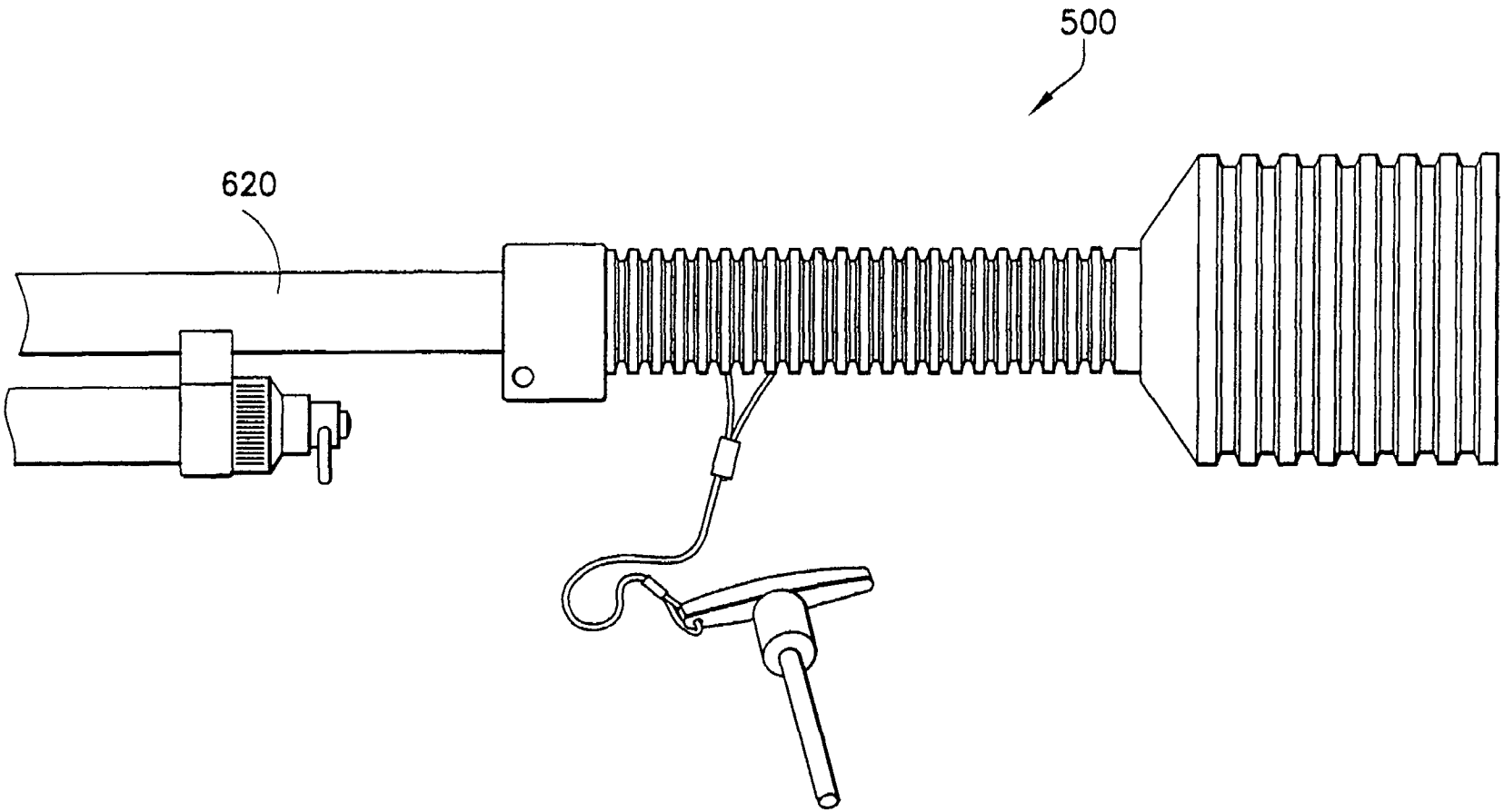
FIGS. 6A-6B show the launcher cup of FIG. 5A being attached to a shotgun according to a second preferred embodiment of the present invention.
Figure 6B:
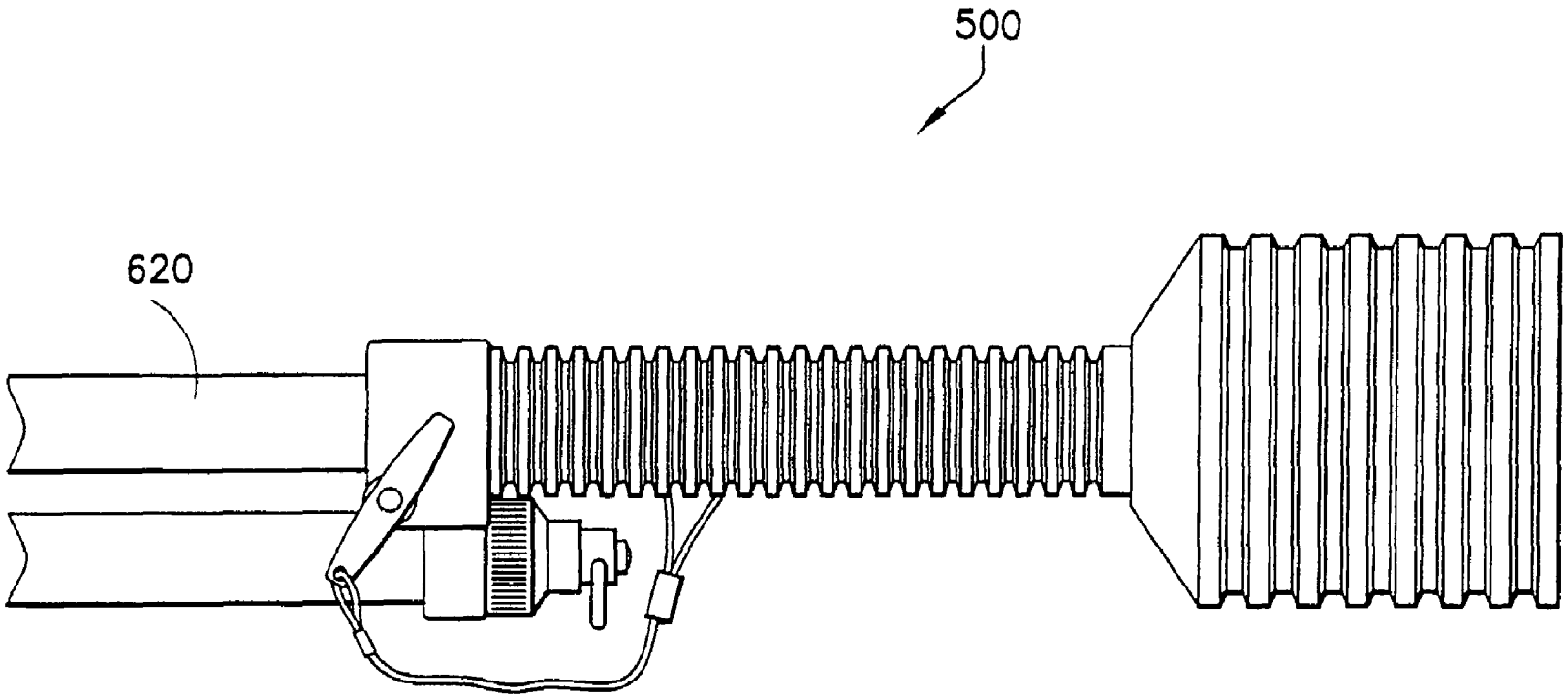

FIGS. 6A-6B show launcher cup 500 sliding, and then locked, onto shotgun 600. In FIG. 6A, magazine tube ring support 650 can be seen on the far right of the drawing. In FIG. 6B, it can be seen that horseshoe section 530 is located on the other side of magazine tube ring support 650, thereby locking launcher cup 500 to the muzzle of shotgun 600 by having T-pin 540 engaged in both holes of horseshoe segment 530.

While there have shown and described and pointed out fundamental novel features of the invention as applied to presently preferred embodiments thereof, it will be understood that various omissions and substitutions and changes in the form and details of the substances, constructions, and orientations illustrated and described, and in their operation, may be made by those skilled in the art without departing from the spirit of the invention.

For example, although a ball-lock safety pin, or T-pin, was used in the presently preferred embodiments, any type of locking, attaching, securing, and/or latching means could be used to secure the launcher cup to the magazine tube ring support of the shotgun (or other type of firearm) in accordance with the present invention. As another example, sections that are shaped differently than the horseshoe shaped section of the presently preferred embodiments could be used with the locking/securing means to secure the launcher cup to the firearm. As yet another example, a portion of the launching cup itself could be used to prevent the launching cup from moving, instead of inserting a pin.

Furthermore, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A launcher cup for holding a projectile at the muzzle of a firearm comprising:

a bell portion for holding the projectile at the muzzle of the firearm;

an adapter portion adjoining said bell portion, said adapter portion for fitting over a barrel of the firearm; and a horseshoe-shaped section adjoining said adapter portion, said horseshoe-shaped section comprising:

a first extension which extends below the barrel of the firearm on a first side of the firearm, said first extension having a first hole therethrough; and a second extension which extends below the barrel of the firearm on a second side of the firearm, said second extension having a second hole therethrough;

wherein, when the adapter portion is fitted over the barrel of the firearm, said horseshoe-shaped portion is located such that said first and second holes are located on one side of a magazine tube ring support of the firearm, and the bell portion of the launcher cup is located on the other side of said magazine tube ring support; and wherein, when said first and second holes are positioned on said one side of said magazine tube ring support, a pin can be inserted through said first and second holes such that the launcher cup is prevented from falling off the muzzle of the firearm because said pin is stopped from moving muzzle-ward on the barrel past a certain point by the magazine tube ring support.

2. The launcher cup of claim 1, wherein the firearm is a shotgun.

3. The launcher cup of claim 1, wherein the adapter portion is contiguous with the bell portion.

4. The launcher cup of claim 1, wherein the adapter portion is contiguous with the horseshoe-shaped section.

5. The launcher cup of claim 1, wherein the adapter portion defines an interior cavity which is sized to fit the barrel of the firearm.

6. The launcher cup of claim 1, wherein the pin comprises a means for engaging at least one of said first and second holes such that said pin can be secured within said first and second holes.

7. The launcher cup of claim 1, wherein the pin comprises a proximal and distal end, said distal end having at least one moveable protrusion, and said at least one movable protrusion preventing the pin from coming out of at least one of said first and second holes.

8. The launcher cup of claim 1, wherein the launcher cup is for launching grenades.

9. The launcher cup of claim 1, wherein the launcher cup is for launching at least one of: a grenade, a net, a noise generator, a stun ball, tire puncturing elements, an electromagnetic pulse generator, a mine or bomblet, a listening device, a signal emitting device, and an unmanned aerial vehicle.

10. A launcher cup for holding a projectile at the muzzle of a firearm comprising:

a bell portion for holding the projectile at the muzzle of the firearm;

an adapter portion adjoining said bell portion, said adapter portion for fitting over a barrel of the firearm; and a stopping section adjoining said adapter portion, said stopping section for stopping the launcher cup from falling off the muzzle of the firearm by using at least a portion of a magazine sub-structure of the firearm to prevent said stopping section from moving muzzle-ward past a certain point along the firearm.

11. The launcher cup of claim 10, wherein the magazine sub-structure comprises at least one of a magazine tube, a magazine tube ring, and a magazine tube ring support.

12. The launcher cup of claim 10, wherein the at least a portion of the magazine sub-structure acts as a stop to at least a portion of the stopping section, thereby preventing the at least a portion of the stopping section from moving muzzle-ward past the at least a portion of the magazine sub-structure.

13. The launcher cup of claim 12, wherein the stopping section comprises at least one extension which extends below the barrel of the firearm on a side of the firearm, and wherein said extension is moveable to at least a first and second positions, where said extension is stopped from moving past the at least a portion of the magazine sub-structure in the first position, and said extension can move freely past the at least a portion of the magazine sub-structure in the second position.

14. The launcher cup of claim 10, wherein the at least a portion of the magazine sub-structure acts as a stop to an element which is attached, connected, or held by at least a portion of the stopping section, thereby preventing the element from moving muzzle-ward past the at least a portion of the magazine sub-structure.

15. A launcher cup for holding a projectile at a muzzle of a firearm comprising:

a bell portion for holding the projectile at the muzzle of the firearm;

an adapter portion adjoining said bell portion, said adapter portion configured to fit over a barrel of the firearm; and a stopping section adjoining said adapter portion, said stopping section configured to stop the launcher cup from falling off the muzzle of the firearm by using at least a portion of a magazine sub-structure of the firearm to prevent said stopping section from moving muzzle-ward past a certain point along the firearm;

wherein the at least a portion of the magazine sub-structure is configured to stop a pin which is insertable through at least one hole in the at least a portion of the stopping section, and, once engaged in said at least one hole, said pin being attached, connected, or held by at least a portion of the stopping section such that the pin is prevented from moving muzzle-ward past the at least a portion of the magazine sub-structure.

16. The launcher cup of claim 15, wherein the at least a portion of the stopping section comprises an extension which extends below the barrel of the firearm on a side of the firearm, and the at least one hole is located below the barrel of the firearm.

17. A launcher cup for holding a projectile at a muzzle of a firearm comprising:

a bell portion for holding the projectile at the muzzle of the firearm;

an adapter portion adjoining said bell portion, said adapter portion configured to fit over a barrel of the firearm; and a stopping section adjoining said adapter portion, said stopping section configured to stop the launcher cup from falling off the muzzle of the firearm by using at least a portion of a magazine sub-structure of the firearm to prevent said stopping section from moving muzzle-ward past a certain point along the firearm;

wherein the stopping section comprises:

a horseshoe-shaped section, said horseshoe-shaped section comprising:

a first extension which extends below the barrel of the firearm on a first side of the firearm; and a second extension which extends below the barrel of the firearm on a second side of the firearm, said second side opposite to the first;

wherein, when the adapter portion is fitted over the barrel of the firearm, said horseshoe-shaped portion is located such that said first and second extensions are located on opposite sides of at least a portion of the magazine sub-structure of the firearm, and an element connecting said first and second extensions prevents said stopping section from moving muzzle-ward past a certain point along the firearm.

18. The launcher cup of claim 17, wherein said element connecting said first and second extensions extends between the barrel of the firearm and the magazine sub-structure of the firearm.

19. The launcher cup of claim 18, wherein said element is stopped from moving past the certain point by a portion connecting the magazine sub-structure to the barrel of the firearm.

20. The launcher cup of claim 19, wherein the element is at least one of moveable and removeable such that said first and second extensions can move freely past the connecting portion of the magazine sub-structure when moved or removed.

* * * * *